United States Patent [19]

Howell

[11] Patent Number: 4,700,256

[45] Date of Patent: Oct. 13, 1987

[54] SOLID STATE CURRENT LIMITING CIRCUIT INTERRUPTER

[75] Inventor: Edward K. Howell, Simsbury, Conn.

[73] Assignee: General Electric Company, New York, N.Y.

[21] Appl. No.: 874,965

[22] Filed: Jun. 16, 1986

Related U.S. Application Data

[63] Continuation-in-part of Ser. No. 610,947, May 16, 1984, abandoned.

[51] Int. Cl.[4] ..... H01H 73/18

[52] U.S. Cl. ..... 361/13; 361/8

[58] Field of Search ..... 361/2, 3, 5, 6, 8, 10, 361/11, 13; 323/289, 290

[56] References Cited

U.S. PATENT DOCUMENTS

| | | | |
|---|---|---|---|
| 3,543,047 | 11/1970 | Renfrew | 307/136 |
| 3,558,910 | 1/1971 | Dale | 307/134 |
| 4,001,742 | 1/1977 | Jencks et al. | 335/173 |
| 4,115,829 | 9/1978 | Howell | 361/42 |
| 4,184,128 | 1/1980 | Nilssen | 323/289 |
| 4,420,784 | 12/1983 | Chen et al. | 361/7 |
| 4,438,472 | 3/1984 | Woodworth | 361/2 |

OTHER PUBLICATIONS

Pat. Applic. Ser. No. 759,710, Edward Keith Howell, "Piezoelectric Contact Driver for Circuit Interrupters", filed Jul. 29, 1985.

*Primary Examiner*—M. H. Paschall
*Assistant Examiner*—Jeffrey A. Gaffin
*Attorney, Agent, or Firm*—Richard A. Menelly; Walter C. Bernkopf; Fred Jacob

[57] ABSTRACT

A solid state current limiting circuit interrupter for the arcless interruption of current through a protected circuit includes a pair of mechanically switched contacts electrically connected in series between the power source and the protected load. A solid state switch becomes electrically connected in parallel across the contacts when the contacts are opened to transfer the current to the solid state switch in a first state of voltage drop lower than arc voltage, and then in a second state of voltage drop higher than power source voltage in which stored energy is dissipated and current is forced to drop to zero to interrupt the circuit.

4 Claims, 15 Drawing Figures

18

SOLID STATE CURRENT LIMITING CIRCUIT INTERRUPTER

This is a continuation-in-part of co-pending Ser. No. 610,947, filed May 16, 1984, now abandoned.

BACKGROUND OF THE INVENTION

Circuit interruption devices generally include a pair of mechanical switching contacts connected between a source of power and the controlled circuit which rapidly become separated by means of an operating mechanism upon command. When the contacts become separated, an arc is formed therebetween which continues to carry current until the current ceases. Since the energy associated with the arc can seriously damage the contacts, it is expedient to stop the current flow as rapidly as possible. The state of the art is resplendent with various arc chamber configurations and materials which are structured to rapidly increase arc voltage. Earlier attempts have been made to provide an "arcless" circuit interrupter wherein semiconductor elements are employed in various combinations with the switching contacts to reduce the effects of arcing. U.S. Pat. No. 3,558,910 to Robert G. Dale, for example, describes a bilateral semiconductor switch connected in parallel with the contacts of an electromechanical relay to prevent contact arcing. U.S. Pat. No. 3,543,047 to Robert M. Renfrew describes a two switch arrangement in series with a low voltage electrical power source and a load. A varistor shunt across one of the switches absorbs the energy to be interrupted when the switch is opened and attenuates the current to reduce the arcing when the other switch is later opened.

U.S. Pat. No. 4,420,784 to Chen et al., entitled "Hybrid DC Power Controller", describes a field effect transistor and a Zener diode between a pair of separable power contacts. An arc chute is required to control the arc that forms across the contacts to increase the arc voltage to reduce the let-through fault current through the contacts.

The purpose of this invention is to provide a solid state switch in parallel with a pair of contacts to first, after opening the contacts, transfer the current from the contacts through the solid state switch at a low voltage drop to extinguish the arc that forms momentarily between the contacts and then to increase the voltage drop in the absence of an arc so that the current then rapidly drops to zero.

SUMMARY OF THE INVENTION

A solid state current limiting circuit interrupter contains a pair of contacts electrically connected in series between a power source and a protected load. A solid state switch arranged in shunt connection across the contacts diverts the current through the solid state switch when the contacts are opened. The current flows through a first circuit element within the solid state switch for a minimum time just sufficient to de-ionize the initial arc plasma and to cool the contact surfaces to a temperature below thermionic emission. The current then transfers through a second circuit element within the solid state switch for a sufficient amount of time to dissipate the energy stored in the inductance of the current path at which time the current drops to zero to interrupt the circuit.

DESCRIPTION OF THE PREFERRED EMBODIMENT

It is understood that an arc will form between separating contacts at the range of currents and voltages involved in most circuit interrupting devices. For purposes of this disclosure, "arcless" interruption is defined as restricting arcing to sufficiently low energy values and to a sufficiently short time duration so as not to produce any significant erosion or damage to the contacts in the absence of an arc chute or channels. To protect the silver and silver-tungsten contacts used with circuit protection devices, it is essential that the initial arc plasma formed upon contact separation be limited to a time sufficient to de-ionize the initial arc plasma and to cool the contact surfaces to a temperature below thermionic emission, usually within 10 to 100 microseconds.

Figure 1:
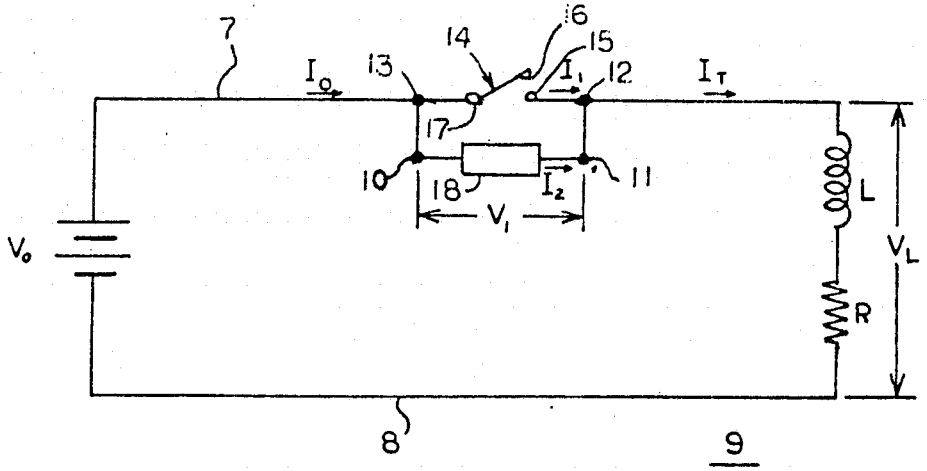
FIG. 1 is a schematic representation of a DC circuit containing a first embodiment of the solid state current limiting circuit interrupter according to the invention.

One embodiment of the solid state current limiting interrupter of the invention comprises the combination of a mechanical switch 14 and a solid state switch 18 connected within circuit 9 as shown in FIG. 1 which includes a voltage source $V_O$, such as a battery, connecting with a load which is defined by an inductance L in series with a resistance R interconnected by a line conductor 7 and a return conductor 8 through the mechanical switch 14 consisting of fixed contact 15 and movable contact 16. One Example of a high speed mechanical switch is found within U.S. patent application Ser. No. 759,710, filed Jul. 29, 1985. Terminals 12, 13 define the conductive path when the mechanical switch is in the closed position and terminals 10 and 11 define the conductive path when the mechanical switch is in an open position. Although mechanical switch 14 is depicted as a single pole, single throw mechanical switch arranged about a pivot 17, other variations of single pole, single throw mechanical switches can also be employed. The solid state switch 18 exhibits two operating states, a first state which is current conduction at a low voltage drop of less than arc voltage, and a second state which is current conduction at a high voltage drop of greater than supply voltage. When it is desired to interrupt the current flow through the circuit, the mechanical switch is opened and the current is immediately transferred through terminals 10 and 11 through the solid state switch 18. The current first flows through the solid state switch 18 with a voltage drop less than 10 volts and diverts current away from the arc which occurs between contacts 15 and 16 when first separated. After a first period of time, in the range of 10 to 100 microseconds, for example, the arc plasma between the contacts has de-ionized and the surfaces of the contacts have cooled to a temperature less than thermionic emission and the contacts have separated sufficiently so that voltage substantially higher than supply voltage can be re-applied without forming an arc. It is believed that the arrangement described within aforementioned U.S. Pat. No. 4,420,784 could cause the contacts usually employed within molded case circuit breakers to become overheated and damaged in the absence of an arc chute. At this time, the solid state switch 18 changes from a first state to a second state in which the voltage drop is higher than the supply voltage. The solid state switch is selected to have voltage-clamping and energy absorbing and dissipating capability such that the energy stored in the inductance of the current path is rapidly absorbed and the current drops nearly linearly to zero in a second period of time, in the range of 100 microseconds to 1 millisecond.

Figure 2:
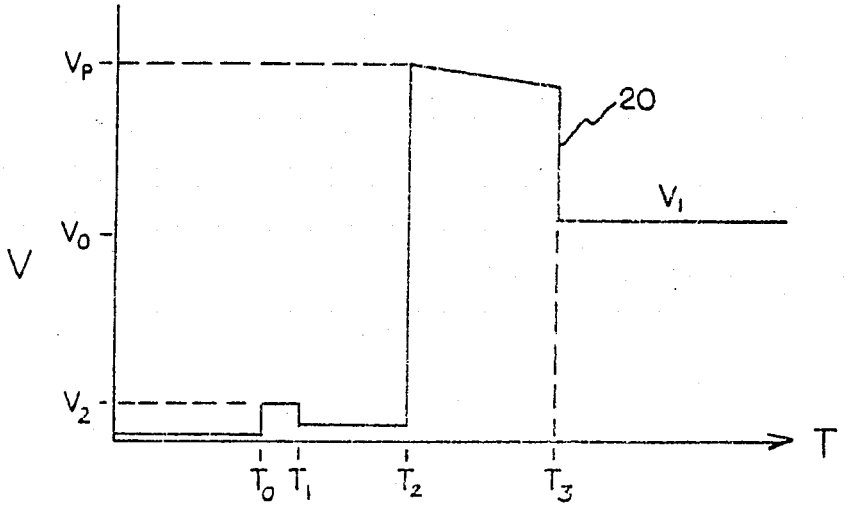
FIG. 2 is a graphic representation of the voltage waveform across the interrupter for the circuit depicted in FIG. 1.
Figure 3:
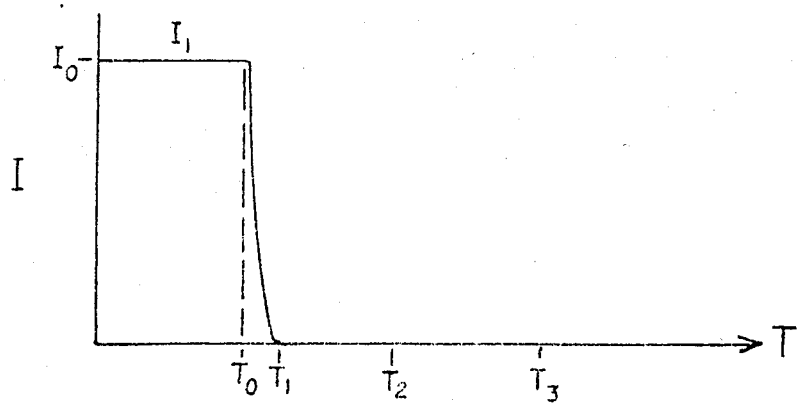
FIG. 3 is a graphic representation of the current waveform through the mechanical switch employed within the circuit of FIG. 1.
Figure 4:
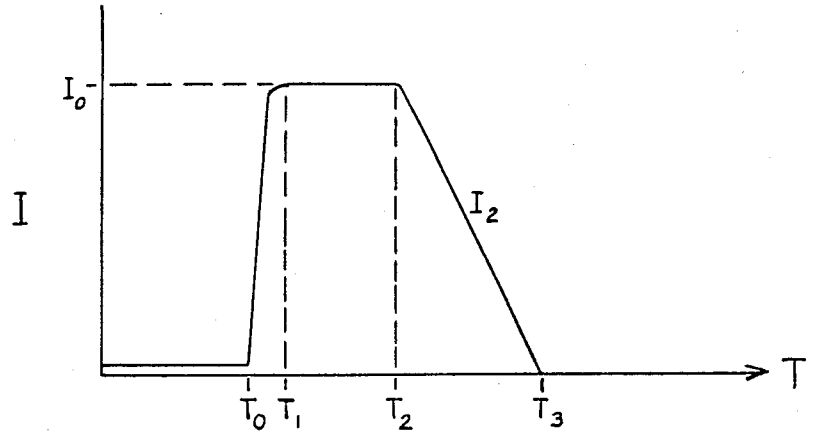
FIG. 4 is a graphic representation of the current waveform through the solid state switch employed within the circuit FIG. 1.
Figure 5:
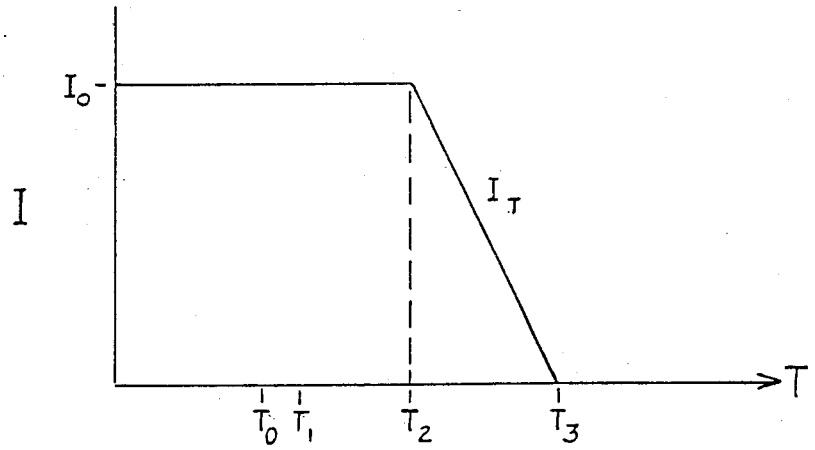
FIG. 5 is a graphic representation of the total current waveform through the circuit of FIG. 1.

For purposes of graphic illustration, $I_t$ represents the total current flow through circuit 9 in FIG. 1 having a value $I_0$ before switch 14 is opened. $I_1$ represents the current flow through the circuit branch defined between terminals 12, 13 through switch 14 and $I_2$ represents the current flow through the circuit branch defined by terminals 10,11 through the solid state switch 18. The voltage waveform 20 representing the voltage across mechanical switch 14 and solid state switch 18 is depicted in FIG. 2 wherein the voltage drop across switch 14 and terminals 10,11 before opening switch 14 is nearly zero and rises slightly to a value $V_2$ equal to the arc voltage drop of approximately 12 volts across contacts 15,16 at $T_0$ when switch 14 is initially opened. For the solid state switch 18 in FIG. 6, $T_1$ represents the time at which all current has been transferred to solid state switch 18. The current path is now represented between terminals 10,11 by $I_2$ which is depicted graphically in FIG. 4. When the mechanical switch 14 first opens at $T_0$, $I_2$ increases from zero to a maximum value equal to the source current $I_0$ while $I_1$ continuously decreases from an initial peak value ($I_0$) at $T_0$ to zero as indicated at $T_1$ in FIG. 3. The voltage waveform 20 in FIG. 2 between time $T_1$ and time $T_2$ is substantially lower than $V_2$ in order to allow de-ionization and cooling. At time $T_2$, solid state switch 18 changes from the low voltage operating state to the high voltage operating state. The voltage waveform 20 in FIG. 2 at time $T_2$ reaches a peak voltage $V_p$ which is substantially higher than the source voltage $V_O$. It can be seen in FIG. 4 that the current $I_2$ through the solid state switch rapidly decreases from a maximum value of $I_0$ at time $T_2$ to zero at time $T_3$ as the energy which had been stored in inductance L is dissipated in the solid state switch. $I_t$, which represents the total current through circuit 9, is depicted in FIG. 5 as remaining at a relatively constant value of $I_0$ until the solid state switch changes state and rapidly falls to zero over the second time increment $T_2$ to $T_3$.

Figure 6:
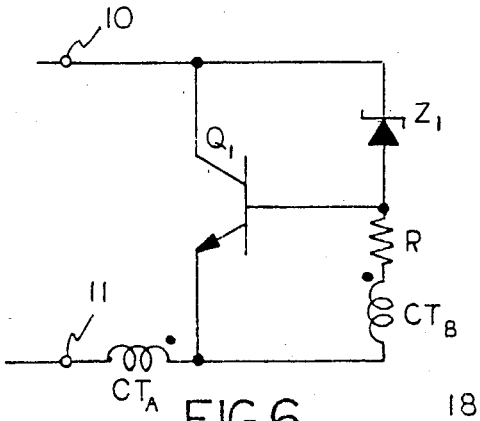
FIG. 6 is a schematic representation of the circuit employed witin the solid state switch of FIG. 1.

The mechanism for controlling the solid state switch 18 is best understood by referring to FIG. 6 wherein the solid state switch 18 comprises the combination of power transistor $Q_1$ and zener diode $Z_1$, both of which are arranged between terminals 10,11 in the circuit represented in FIG. 1. For purposes of illustration a single bipolar transistor is depicted. However, multiple Darlington connected bipolar transistors, field effect transistors, field controlled transistors, and gate turnoff devices such as thyristors can also be employed. One of the reasons for the successful "arcless" interruption attained by the solid state switch 18 depicted in FIG. 6 is that large amounts of collector current can be controlled by relatively small magnitudes of base current during the low voltage operating state. The control requirements for the solid state switch 18 are provided by means of a current transformer whose primary winding $CT_a$ is connected between terminal 11 and the emitter of $Q_1$ and secondary winding $CT_b$ which is connected between the base and emitter to provide base drive to $Q_1$. When the mechanical switch 14 first opens, a voltage is created and is applied across the combination of the zener diode capacitance and current transformer secondary $CT_b$ producing sufficient initial base current to drive $Q_1$ into conduction and sufficient regenerative current to maintain $Q_1$ in its conductive state. By a careful selection of the size and material used to provide the magnetic core, the current transformer can be caused to saturate at time $T_2$, turning off transistor $Q_1$. Inductance L causes the voltage V across terminals 10, 11 to increase whereby zener diode $Z_1$ becomes conductive to provide base current for transistor $Q_1$ in the high voltage operating state of the solid state switch as described earlier with reference to FIGS. 2–5.

Figure 7:
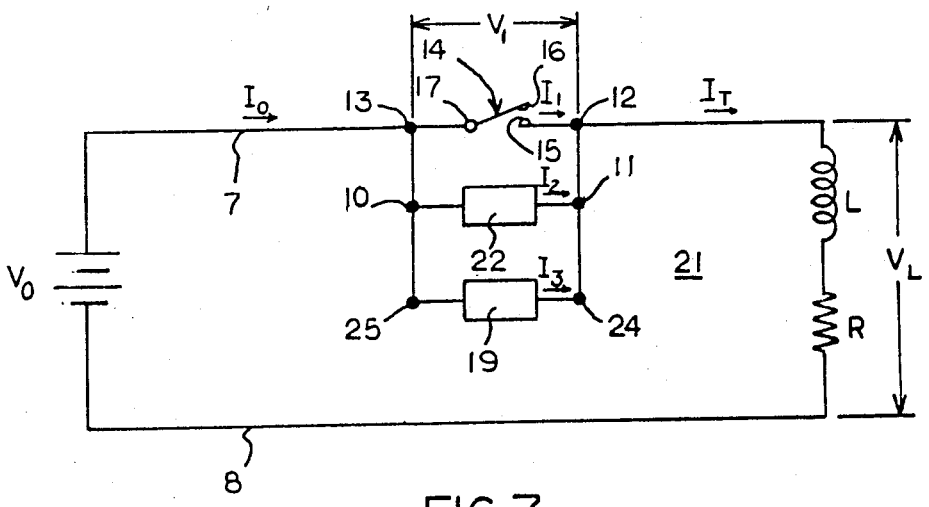
FIG. 7 is a schematic representation of a DC circuit containing a second embodiment of the solid state current limiting circuit interrupter according to the invention.

A second embodiment of the solid state current limiting interrupter of the invention includes the solid state switch 21 depicted in FIG. 7 wherein the low voltage operating state is provided by the controlled low voltage conducting element 22, hereafter "controlled element", and the high voltage conducting state is provided by the high voltage conducting element 19, hereafter "high voltage element". The controlled element 22 is similar to that described earlier for the solid state switch 18 of FIG. 1. The high voltage element 19 must be capable of absorbing and dissipating a relatively large amount of electrical energy in a short period of time without becoming damaged. One such solid state device having a voltage dependent resistance is the metal oxide varistor (MOV) having the composition described in U.S. Pat. No. 4,374,049 (Ellis et al.).

Figure 8:
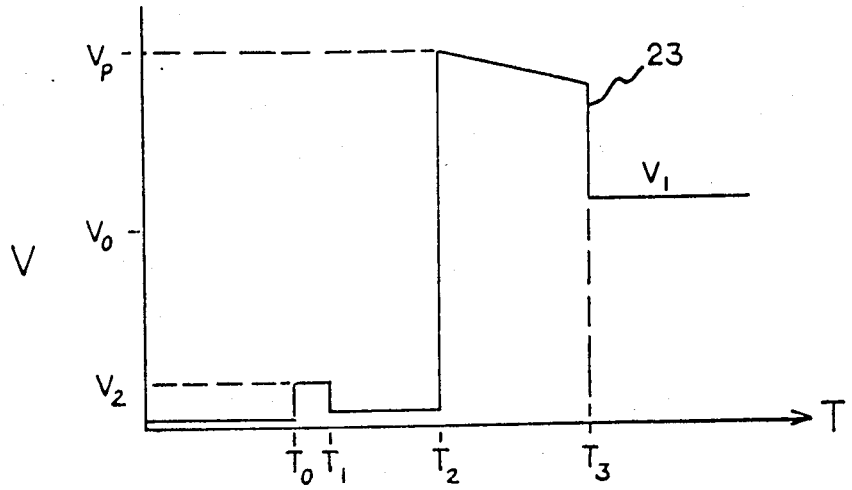
FIG. 8 is a graphic representation of the voltage waveform across the interrupter for the circuit depicted in FIG. 7.
Figure 9:
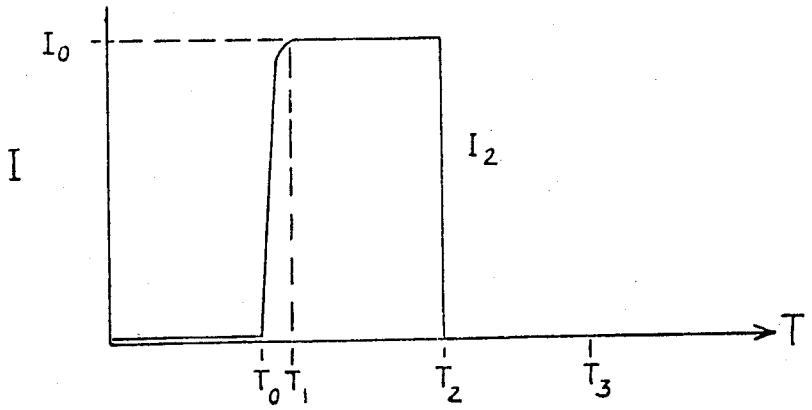
FIG. 9 is a graphic representation of the current waveform through a first circuit element within the solid state switch employed within the circuit of FIG. 7.
Figure 10:
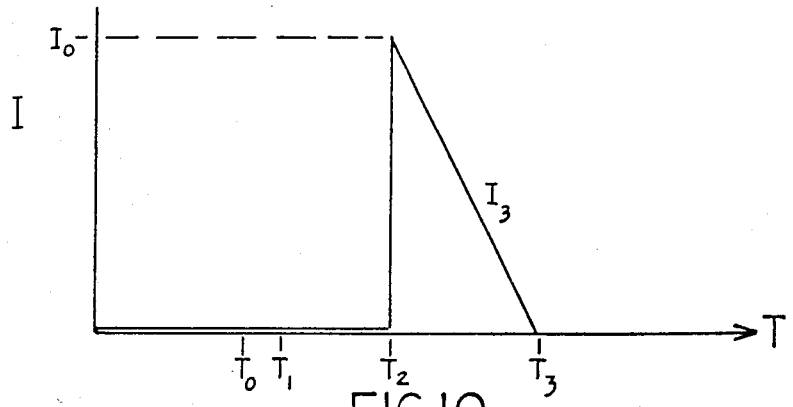
FIG. 10 is a graphic representation of the current waveform through a second circuit element within the solid state switch employed within the circuit of FIG. 7.
Figure 12:
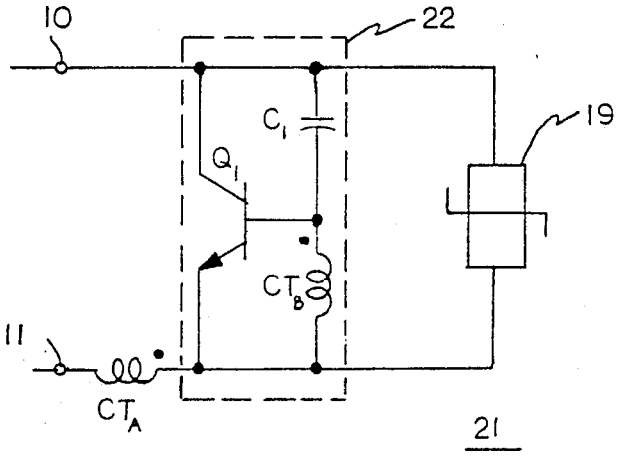
FIG. 12 is a schematic representation of the circuit employed within the solid state switch of FIG. 7.

The circuit for the solid state switch 21 is depicted in FIG. 12 wherein the controlled element 22 is similar to that shown in FIG. 6 with a capacitor $C_1$ substituted for the zener diode $Z_1$. The capacitor in combination with the inductance provided by the secondary current transformer winding $CT_b$ provides the initial voltage for turning on transistor $Q_1$ in the manner described earlier. Once $Q_1$ is turned off, by saturation of the current transformer core, the current then transfers through the MOV 19. The applicable voltage waveform 23 is depicted in FIG. 8 and the current waveforms are depicted in FIGS. 9 and 10 for the same time increments as those shown in FIGS. 2–5 such that common reference numerals will be employed where possible. In FIG. 7 the additional current path through MOV 19 between terminals 24, 25 is depicted as $I_3$. The current $I_1$ and $I_t$ through the mechanical switch 14 and the total current through the circuit respectively, are the same for both of the embodiments depicted in FIGS. 7 and 1 such that only the current waveforms $I_2$ through the controlled element 22 and $I_3$ through the high voltage element 19 will be depicted in FIGS. 9 and 10 respectively.

Referring now to FIG. 8, the voltage waveform 23 is shown to vary from a low initial value with switch 14 in the closed position, to a slightly higher value at time $T_0$ when the switch is first opened which represents an arc voltage drop across contacts 15, 16 in the order of approximately 12 volts. At time $T_1$, the current has completely transferred to element 22 between terminals 10, 11, as represented by $I_2$. FIG. 9 shows current $I_2$ at zero when switch 14 is closed and rapidly increasing to a maximum value of $I_0$ in the time increment $T_0$ to $T_1$, which represents the time it takes for the current to transfer from current path 12, 13 to current path 10, 11. $I_2$ remains relatively constant through the controlled element 22 which is represented by the time increment $T_1$ to $T_2$. At time $T_2$, the controlled element 22 turns off and the high voltage element 19 becomes conductive. The voltage waveform across terminals 12, 13 as shown in FIG. 8 has a maximum value $V_p$ at time $T_2$ and decreases slightly over the time increment $T_2$ to $T_3$ before abruptly dropping to source voltage $V_0$ at time $T_3$. The current $I_3$ through high voltage element 19 rapidly decreases to zero over the same time increment, as shown in FIG. 10.

Figure 13:
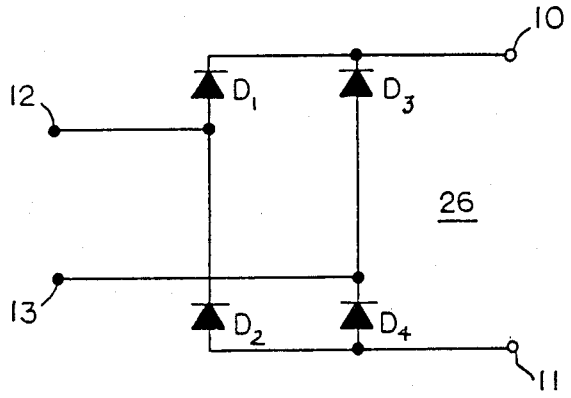
FIG. 13 is a rectifier circuit for connection within the embodiment of FIG. 1 when used within an AC circuit.

When the solid state switch 18 of FIG. 1 is employed within an AC circuit such that the voltage source $V_0$ is an alternating current source, the bridge rectifier circuit 26 consisting of diodes $D_1$–$D_4$ shown in FIG. 13 is interposed between terminals 12, 13 and 10, 11. The solid state switch 18 behaves in an identical manner as described earlier with reference to the waveforms depicted in FIGS. 2–5.

Figure 14:
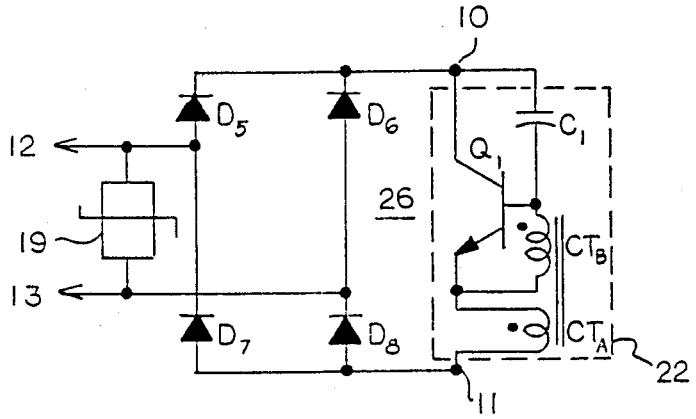
FIG. 14 is a diagramatic representation of the circuit of FIG. 12 adapted for an AC circuit.

When an AC voltage source is employed with the solid state switch 21 depicted in FIG. 7, the circuit arrangement shown in FIG. 14 is employed. In this arrangement, the high voltage element 19 is connected across terminals 12, 13 in the AC portion of the bridge rectifier 26 and the controlled element 22 is connected across terminals 10, 11 in the DC portion of the bridge rectifier. Although the high voltage element 19 could be connected across the DC portion of the bridge rectifier in a manner similar to that described earlier with reference to FIG. 12, the high voltage element is more stable when operated on AC. Within the controlled element 22, a capacitor $C_1$ is connected between the collector and base of transistor $Q_1$ in order to provide a turn-on current pulse to the base of the transistor in the same manner as described earlier. The current transformer windings $CT_a$ and $CT_b$ are employed in a similar manner to provide the regenerative base drive for transistor $Q_1$. Although the use of a saturable core current transformer to switch between the low voltage and high voltage conduction states of the solid state switch is described in the instant invention, other means for turning off the controlled element 22 may be employed without deviating from the scope and objects of the invention.

Figure 11:
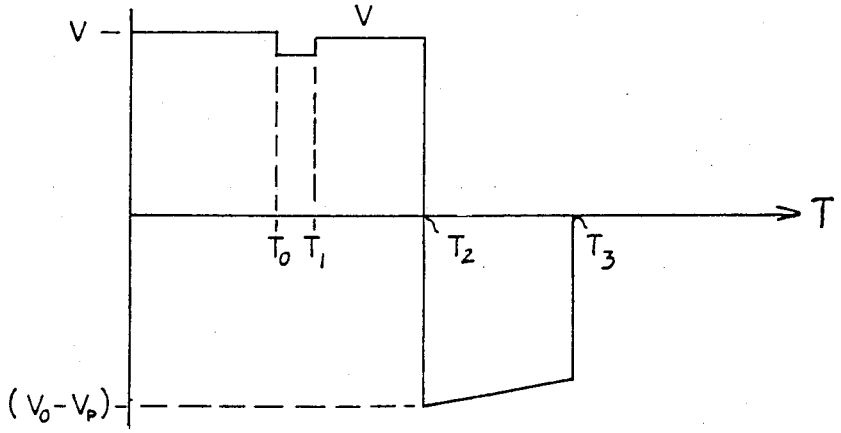
FIG. 11 is a graphic representation of the voltage waveform across the load depicted within the circuit of FIG. 7.

The load voltage $V_L$ which was defined earlier as the voltage across the load represented by an inductance L and resistance R for the embodiment of FIG. 7 is depicted graphically in FIG. 11. When the mechanical switch 14 is closed, the voltage $V_L$ is the source voltage $V_O$ and remains constant until time $T_O$ when the mechanical switch is opened and a small arc voltage drop in the order of 12 volts occurs across contacts 15, 16. At time $T_1$, current $I_2$ flows through the controlled element 22 and the load voltage approaches $V_0$. At time $T_2$, the high voltage element 19 becomes conductive, and current $I_3$ flows through the circuit path defined between terminals 24, 25. The load voltage $V_L$ then abruptly drops to a negative value which is equal to the difference between the source voltage $V_O$ and the peak voltage $V_p$. The voltage across the load remains negative until the current $I_3$ decreases to zero at time $T_3$ as shown in FIG. 10 at which time the load voltage also becomes zero.

Figure 15:
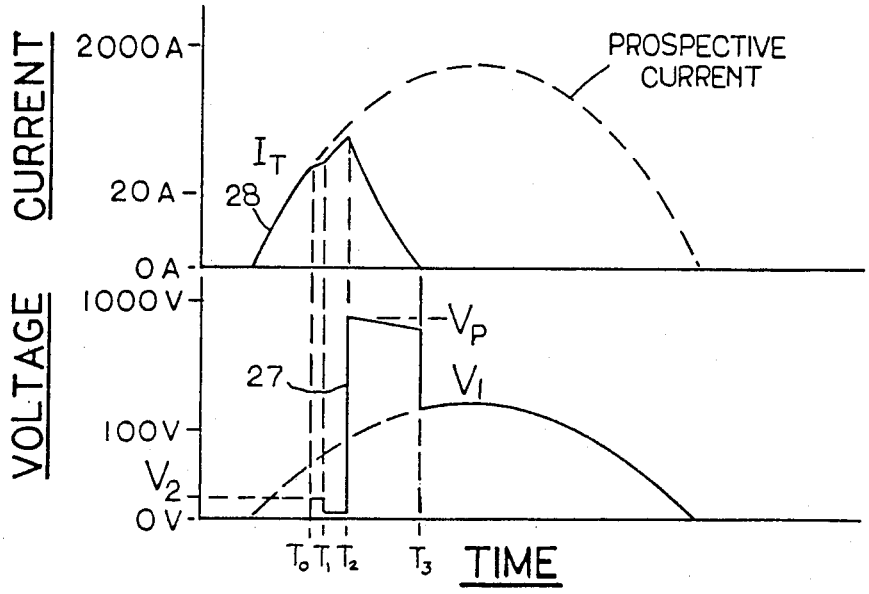
FIG. 15 is a graphic representation of the current and voltage waveforms for the AC circuit depicted in FIG. 14.

The earlier embodiments depicted in FIGS. 1 and 7 are used when "arcless" switching is required such as in an explosive atmosphere in mines, for example, and when "noise-free" switching is required such as with sensitive electronic equipment such as within computers. The solid state current limiting circuit interrupter of the invention also finds important application as a circuit protection device wherein it is necessary to interrupt current through a circuit to protect the circuit and the circuit components from excess current damage. When the interrupter of the invention is used in such an application, no arc chute or other arc handling device is required. When used as a protective device, a current sensor, such as a current transformer, is arranged with its primary winding encompassing the line conductor 7 in FIG. 7 and its output winding is operatively connected with an interrupting mechanism to rapidly open the mechanical switch 14 when the current reaches a pre-determined value. The use of one such current transformer and operating mechanism within a protected circuit is described, for example, in U.S. Pat. No. 4,115,829 to E. K. Howell and U.S. Pat. No. 4,001,742 to C. L. Jencks et al and reference should be made to these patents for a detailed description. The total current waveform $I_t$ and the voltage waveform 27 across terminals 12, 13 for the solid state switch 21 depicted in FIG. 7 within an AC voltage source are shown in FIG. 15. At a pre-determined value of current, the mechanical switch 14 is opened at time $T_0$. V represents the voltage across the controlled element 22 and is equal to the arc voltage drop $V_2$ developed across the contacts until time $T_1$ at which time the current flows through the controlled element 22 and the voltage drops to a new value representing the slight voltage drop across the controlled element 22. At time $T_2$, the controlled element 22 turns off and the current now flows through the high voltage element 19 as described earlier with reference to the solid state switch 21 shown in FIG. 12. The voltage across high voltage element 19 rapidly increases to a peak value $V_p$ as described earlier. The current through the high voltage element rapidly drops to zero to completely interrupt the current flow at time $T_3$ at which time the voltage across the solid state element assumes the normal line voltage waveform as indicated.

It is thus appreciated that an arcless current limiting circuit interrupter can be realized by means of a rapid-opening mechanical switch to interrupt the current through the circuit at an early stage in the current waveform as depicted in FIG. 15 to limit the circuit current to a relatively low value compared to the indicated prospective current. The cooperative employment of a controlled element for switching current away from the mechanical switch contacts to de-ionize the arc plasma and cool the contacts to a temperature lower than thermionic emission for withstanding the re-applied voltage with a high voltage element to dissipate the stored energy achieves complete circuit interruption with the lowest energy arc across the contacts ever previously attained.

Having thus described my invention, what I claim as new and desire to secure by Letters Patent is:

1. An arrangement for rapidly interrupting load current flow with minimal arcing, comprising:

(a) electromechanical switching means having fixed and movable contacts for connection between a source of electric power and a load and constructed to permit extremely rapid separation of said contacts for interrupting load current flow through said contacts;

(b) semiconductor switching means comprising first and second primary electrodes and a control electrode;

(c) first means for switching on said semiconductor switching means and transferring load current away from said contacts, through said semiconductor switching means substantially instantly upon initial separation of said contacts and for thereafter maintaining said semiconductor switching means fully conductive for an interval sufficient to provide for de-ionization of any arc between said contacts and for sufficiently cooling and separating said contacts to permit reapplication of a voltage across said contacts which is greater than the voltage of the source of electric power, said interval being in the order or approximately 100 microseconds;

(d) said first means comprising:

(1) saturable transformer means having a primary winding, a secondary winding and a saturable core;

(2) said primary winding being coupled in series circuit with said first and second primary electrodes across said contacts; and (3) said secondary winding being coupled between said control electrode and one of said first and second primary electrodes for turning on said solid state switching means responsive to the voltage created across said contacts upon their initial separation and for turning off said solid state switching means upon saturation of said saturable core; and (e) voltage responsive means connected in circuit across said contacts for transferring load current subsequent to turn off of said solid state switching means and subsequent to the voltage across said voltage responsive means exceeding the voltage of said source of electric power.

2. The arrangement of claim 1 wherein said solid state switching means comprises at least one transistor, said first and second primary electrodes comprise a collector and emitter and said control electrode comprises a base electrode of said at least one transistor, and wherein said voltage responsive means comprises a varistor.

3. The arrangement of claim 2 wherein said secondary winding is coupled between said base electrode and said emitter electrode.

4. The solid state circuit interrupter of claim 3 further including a Zener diode connected between a collector of said transistor and said transistor base for providing initial voltage for turning on said transistor when said fixed and movable contacts first become separated.

* * * * *